United States Patent [19]

Stines

[11] Patent Number: 4,912,955

[45] Date of Patent: Apr. 3, 1990

[54] SPRAY SYSTEM FOR ROLLING MILL

[75] Inventor: Thomas B. Stines, Huntingdon, Tenn.

[73] Assignee: Norandal USA Inc., Huntingdon, Tenn.

[21] Appl. No.: 279,772

[22] Filed: Dec. 5, 1988

[51] Int. Cl.[4] ..... B21B 27/10

[52] U.S. Cl. ..... 72/45; 72/201; 72/236

[58] Field of Search ..... 72/41, 45, 43, 44, 200, 72/201, 236

[56] References Cited

U.S. PATENT DOCUMENTS 1,994,691 3/1935 Dahl et al. ..... 72/236
1,994,721 3/1935 Lorig et al. ..... 72/201
3,656,330 4/1972 Brown et al. ..... 72/201 X

FOREIGN PATENT DOCUMENTS 61-235014 10/1986 Japan ..... 72/236
1433301 4/1976 United Kingdom ..... 72/201

*Primary Examiner*—E. Michael Combs
*Attorney, Agent, or Firm*—Fleit, Jacobson, Cohn, Price, Holman & Stern

[57] ABSTRACT

A spray system for use in a rolling mill comprises a carriage assembly mounted on linear bearings for movement along an X-axis parallel to an horizontal line passing through the bite of two superposed work rolls, two spray manifolds mounted on the carriage assembly along a Y-axis parallel to a vertical centerline passing through the work rolls, each manifold containing at least one spray nozzle for setting a predetermined spray pattern on each work roll, a carriage traverse mechanism for adjusting the traverse position of the carriage assembly along the X-axis, and two manifold lift mechanisms mounted on the carriage assembly to independently adjust the position of each spray manifold along the Y-axis.

3 Claims, 1 Drawing Sheet

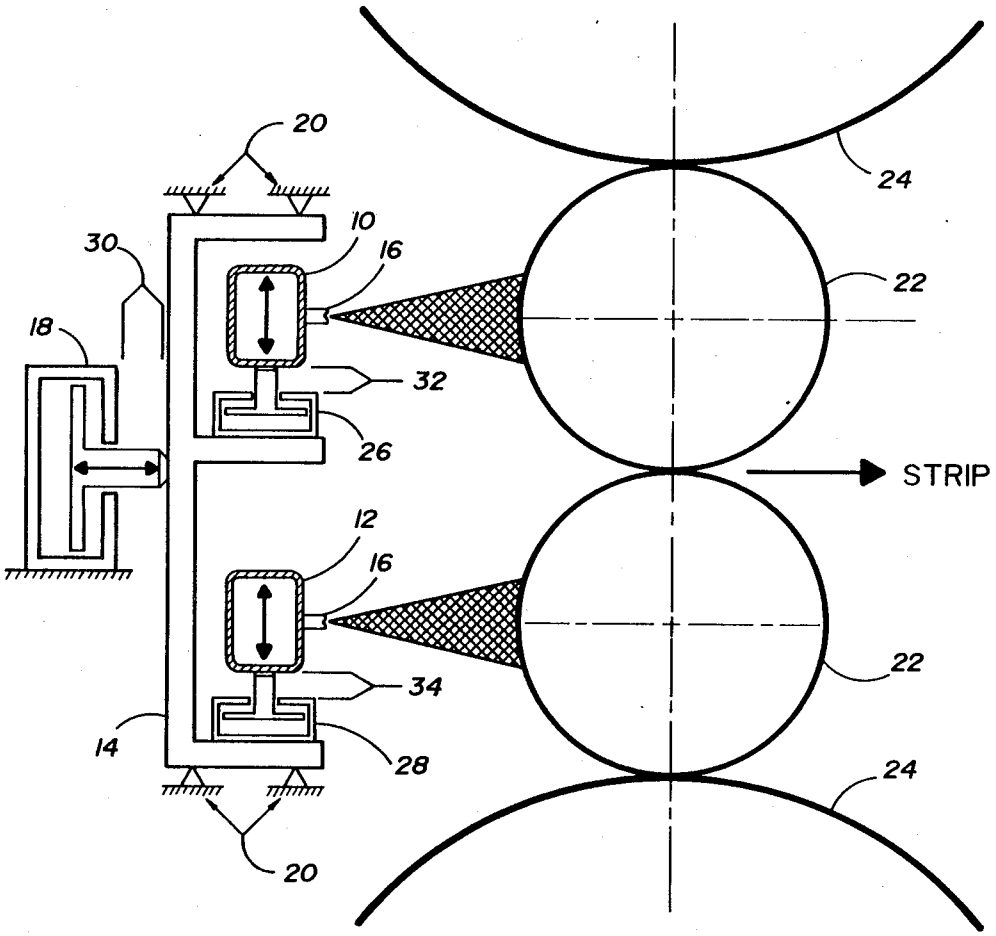
STRIP
24
22
22
24
10
16
32
26
12
16
34
28
20
20
30
18
14

SPRAY SYSTEM FOR ROLLING MILL

This invention relates to a spray system for use in all types of rolling mills.

It is common practice in rolling mills, more particularly in aluminum rolling mills, to apply an oil or water based coolant or lubricant to the work rolls to control shape of the rolled sheet and to prevent sticking of the aluminum sheet to the rolls. The coolant or lubricant is normally applied in the form of coolant sprays of various capacities and pattern geometries using one or more spray nozzles per zone widths in the range but not limited to 55 mm, mounted at predetermined locations with respect to each roll. Upon initial design of the spray system, an optimum spray pattern is conceived based upon the application. However as the roll diameters and position of the strip change within the rolling mill, it becomes necessary to change the spray pattern by moving the spray nozzles. This operation is time consuming more particularly if it is necessary to stop the operation of the rolling mill.

It is therefore the object of the present invention to provide a spray system which may be easily adjusted to provide an optimum spray pattern and to modify such spray pattern when needed.

The spray system, in accordance with the present invention, comprises a carriage assembly mounted on linear bearings for movement along an X-axis, two spray manifolds mounted along a Y axis on the carriage assembly, each manifold containing at least one spray nozzle for setting a predetermined spray pattern on each work roll, a carriage traverse mechanism for adjusting the traverse position of the carriage assembly along the X axis, and two manifold lift mechanisms mounted on the carriage assembly to independently adjust the position of each spray manifold along the Y axis.

For the purpose of defining a suitable coordinate system for the spray system, the X-axis shall be any directed line parallel to the horizontal centerline through the work roll bite and the Y-axis shall be any directed line parallel to the vertical centerline of the work rolls.

An adjustment area for such items as shims is provided between the traverse mechanism and the carriage assembly to set the traverse position of the carriage assembly. Similarly, adjustment areas are provided between each lift mechanism and the associated spray manifold to set the position of the top and bottom spray manifolds.

The invention will now be disclosed, by way of example, with reference to the accompanying drawing which illustrates a schematic view of the spray system in accordance with the present invention.

Referring to the drawing, there is shown a spray system comprising two spray manifolds 10 and 12 mounted on a carriage assembly 14. Each spray manifold may contain a single nozzle 16 per spray zone as shown or a multiple of spray nozzles per spray zone. There are generally 2 or 3 spray nozzles for each zone width of roll. A carriage traverse mechanism 18, such as but not limited to a pneumatic cylinder, is provided for moving the carriage assembly on suitable bearings 20, along an X-axis parallel to an horizontal line passing through the bite of two superposed work rolls 22 which are pressurized by backing rolls 24. Two lift mechanisms 26 and 28 are provided for independently adjusting the position of each spray manifold along a Y-axis parallel to the vertical centerline of the work rolls.

The spray manifolds 10 and 12 are each set at a predetermined X and Y coordinate within the aluminum rolling mill in order to precisely locate the positions of the spray nozzles with respect to the surfaces of the work rolls 22. Upon initial design of the spray system, an optimum spray pattern is conceived based upon the application. This optimum spray pattern determines an X and Y position where the spray nozzle or nozzles must be located within the aluminum rolling mill with respect to the geometric position of the roll surfaces.

X and Y position references are initially established with respect to the optimum spray pattern and the maximum roll diameters. As the roll diameters and position of the strip change within the rolling mill, the X and Y coordinates of the spray manifolds are changed by operation of the traverse and lift mechanisms.

Since the roll stack centerline is at a fixed X location within the rolling mill, a single traverse mechanism 18 is used to move the X coordinates of both spray manifolds 10 and 12 mounted on carriage assembly 14 with respect to the stack centerline. At the optimum X location from the geometric roll surface, thickness shims are inserted in shim area 30 between the traverse mechanism and the carriage assembly to set the position of the carriage assembly.

The Y position of the strip within the rolling mill can vary due to diametrical grind-down and subsequent stack shimming of the backup and work rolls. Because of this, the Y position of the top work roll and bottom work roll manifolds 10 and 12 must be controlled independently. Thickness shims are inserted in shim areas 32 and 34 between the lift mechanisms 26 and 28 and the roll manifolds 10 and 12 to set the position of the manifolds.

Although mechanical thickness shims are disclosed for setting the position of the carriage assembly or the position of the manifolds, it is to be understood that other means such as hydraulic or electrical servo controls could be used for that purpose.

Although the direction of movement of the strip is shown as left to right, it is to be understood that the spray system in accordance with the invention could apply to a reversing mill or to exit sprays on a single stand or tandem mill.

Although the invention has been disclosed with reference to a preferred embodiment, it is to be understood that the invention is not limited to such embodiment and that other alternatives are also envisaged within the scope of the following claims.

I claim:

1. A spray system for use in a rolling mill comprising two superposed work rolls between which is defined a bit through which passes a metal strip to be rolled, said spray system comprising:

(a) a carriage assembly mounted on linear bearings for movement along an X-axis parallel to an horizontal line passing through the bite of the two superposed work rolls;

(b) two spray manifolds mounted on said carriage assembly along a Y-axis parallel to a vertical centerline passing through the work rolls, each manifold containing at least one spray nozzle for setting a predetermined spray pattern on each work roll;

(c) a carriage traverse mechanism for adjusting the traverse position of the carriage assembly along said X-axis; and (d) two manifold lift mechanisms mounted on the carriage assembly to independently adjust the position of each spray manifold along said Y-axis.

2. A spray system as defined in claim 2, wherein adjustment shims are provided between said traverse mechanism and said carriage assembly to set the traverse position of the carriage assembly.

3. A spray system as defined in claim 1 wherein adjustment shims are provided between each lift mechanism and the associated spray manifold to set the position of the spray manifolds.

* * * * *